US010112789B2

(12) United States Patent
Valenzuela et al.

(10) Patent No.: US 10,112,789 B2
(45) Date of Patent: Oct. 30, 2018

(54) CONTACT INTERFACE

(71) Applicant: HEWLETT-PACKARD DEVELOPMENT COMPANY, L.P., Houston, TX (US)

(72) Inventors: Rene Valenzuela, San Diego, CA (US); Ryan M. Smith, San Diego, CA (US); Ken Hung, Taoyuan (TW); Jeff Lin, New Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 2 days.

(21) Appl. No.: 15/296,490

(22) Filed: Oct. 18, 2016

(65) Prior Publication Data

US 2018/0105377 A1 Apr. 19, 2018

(51) Int. Cl.
*B65H 1/12* (2006.01)
*B65H 1/14* (2006.01)

(52) U.S. Cl.
CPC ..... *B65H 1/12* (2013.01); *B65H 1/14* (2013.01); *B65H 2401/10* (2013.01); *B65H 2403/60* (2013.01); *B65H 2404/5322* (2013.01); *B65H 2601/521* (2013.01); *B65H 2801/06* (2013.01)

(58) Field of Classification Search
CPC ..... B65H 1/12; B65H 1/14; B65H 2401/10; B65H 2404/5321; B65H 2404/5322; B65H 2601/521; B65H 3/5223; B65H 2403/60; Y10T 74/2101; Y10T 74/2107; F16F 15/043; F16H 53/06
USPC ..... 74/569
See application file for complete search history.

(56) References Cited

U.S. PATENT DOCUMENTS

| | | | | |
|---|---|---|---|---|
| 4,610,445 | A | 9/1986 | Schneider et al. | |
| 4,970,662 | A | 11/1990 | Tanaka et al. | |
| 5,253,854 | A * | 10/1993 | Tanoue | B65H 3/5223 271/10.11 |
| 5,320,337 | A * | 6/1994 | Itoh | B65H 3/5223 271/121 |
| 5,358,230 | A | 10/1994 | Ikemori et al. | |
| 7,481,423 | B2 * | 1/2009 | Lim | B65H 3/5223 271/118 |
| 7,699,306 | B2 | 4/2010 | Lim et al. | |
| 7,712,736 | B2 | 5/2010 | Chinzei | |
| 9,511,962 | B2 * | 12/2016 | Tanaka | B65H 3/06 |

* cited by examiner

*Primary Examiner* — Jeremy R Severson
(74) *Attorney, Agent, or Firm* — HP Inc. Patent Department

(57) ABSTRACT

A contact interface includes a first contact member including a first contact surface with a first material subsurface and a second material subsurface. The second material subsurface protrudes transversely above the first material subsurface. A second contact member includes a second contact surface to slide in contact with the first contact surface. The first material subsurface comprises a first material. The second material subsurface comprises a second material. The second material has a lower hardness than the first material.

14 Claims, 8 Drawing Sheets

CONTACT INTERFACE

BACKGROUND

A printer, scanner, or other office machine may include an automatic document feeder ("ADF"). Many ADFs include a media handling tray which transitions, through action of a lifting mechanism and related motors and gears, between lowered ready and lifted feeding positions during use of the ADF.

DETAILED DESCRIPTION

Figure 1A:
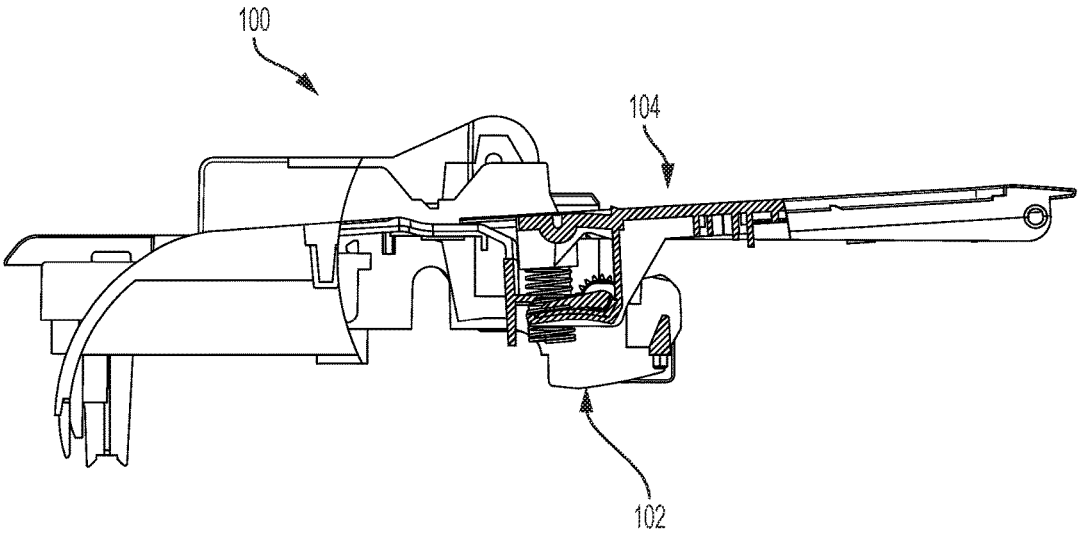
FIG. 1A schematically illustrates a partial cross-sectional side view of an example ADF in a lifted feeding position.
Figure 1B:
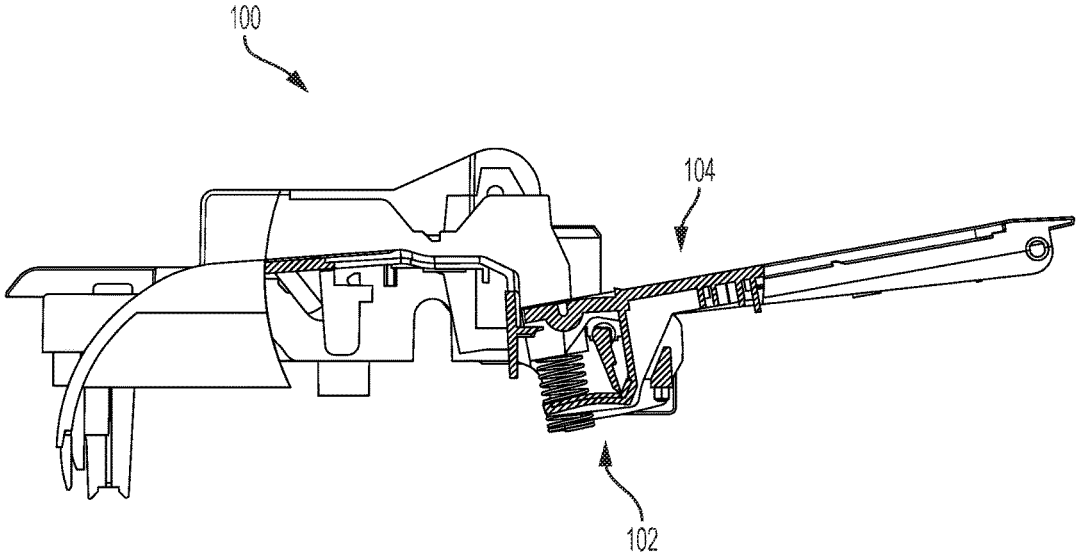
FIG. 1B schematically illustrates a partial cross-sectional side view of the example ADF of FIG. 1 in a lowered ready position.

An ADF or analogous feature could be provided to an imaging device, a two-dimensional printer, a three-dimensional printer, and/or any machine which involves the handling of media including, but not limited to, paper, plastic, metal, and wood. During transition of a media handling tray of an ADF between lowered ready and lifted feeding positions, various portions of the lifting mechanism may impact each other with sufficient force to provide unwanted noise, and potentially undesired wear of the components of the lifting mechanism. FIGS. 1A-1B illustrate an ADF 100 including a lifting mechanism 102 for a media handling tray 104. In FIG. 1A, the media handling tray 104 is in a lifted feeding position. In FIG. 1B, the media handling tray 104 is in a lowered ready position.

Figure 2A:
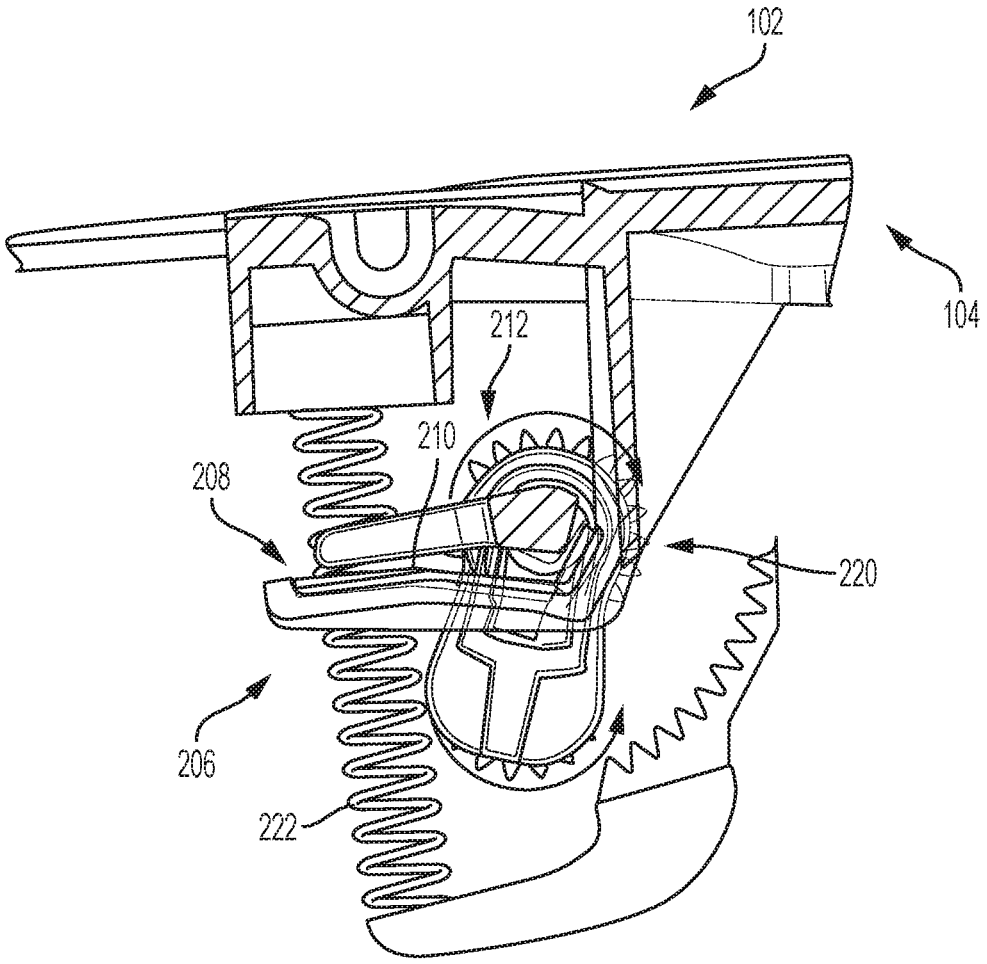
FIG. 2A schematically illustrates a side view of the example ADF in the position of FIG. 1A.
Figure 2B:
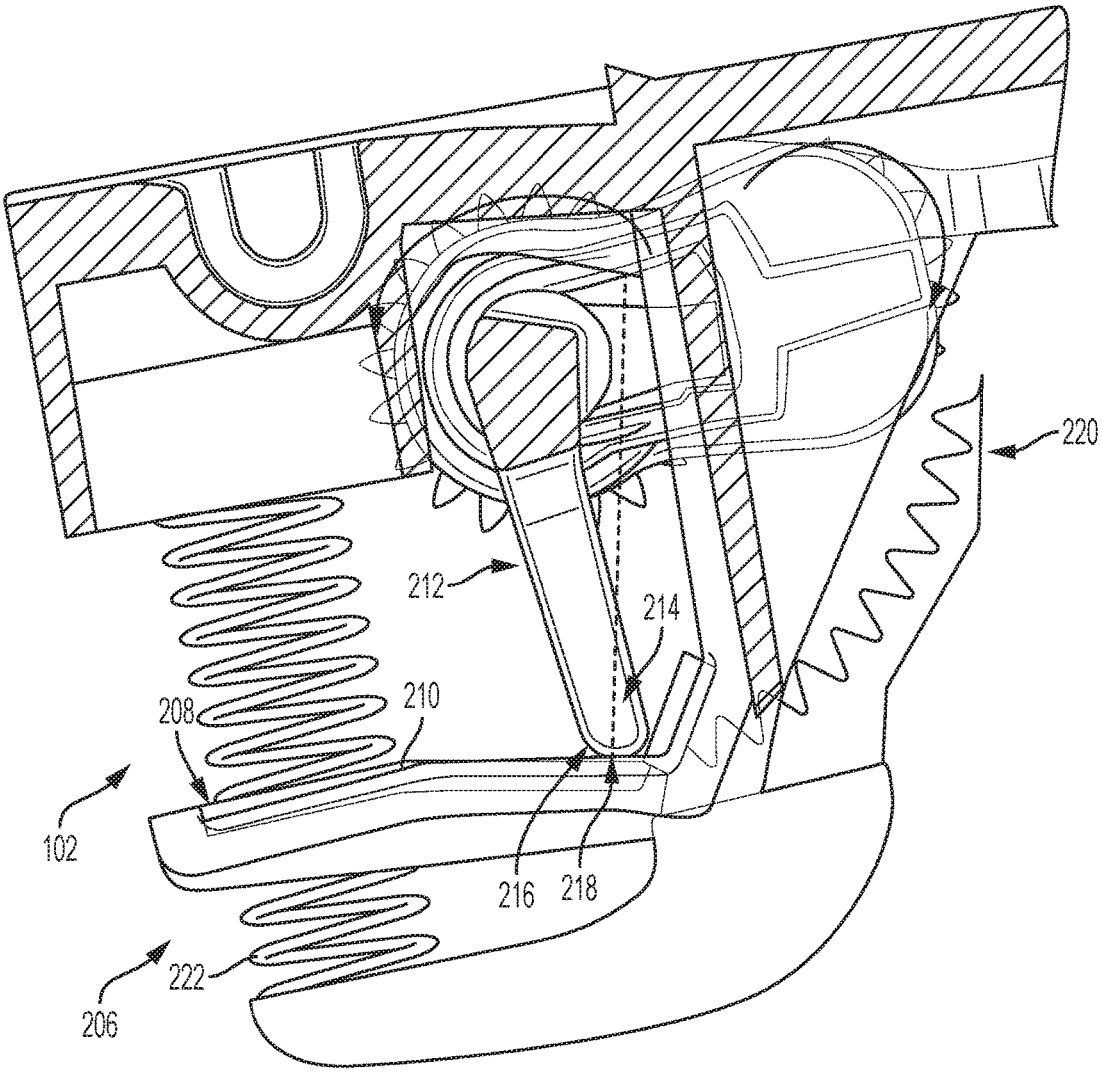
FIG. 2B schematically illustrates a side view of the example ADF in the position of FIG. 1B.

FIGS. 2A-2B illustrate the lifting mechanism 102 in lifted feeding and lowered ready positions, respectively. For reference, FIGS. 2A-2B include an indication of the frame of reference that will be used for clarity of description herein, including orthogonal longitudinal, lateral (into and out of the paper, in the orientation of FIGS. 2A-2B), and transverse directions. It should be understood that these directions, while internally consistent throughout the included drawings and description, will change as the frame of reference of the Figures changes.

As is shown in FIGS. 2A-2B, a base arm 206 is fixed to tray 104 and supports a first surface 208 including a first contact surface 210. A pivotally mounted swing arm 212 may have a tip 214 comprising a second contact member 216 longitudinally movable with respect to, such as by sliding in contact with, the first surface 208. The second contact member 216 has a second contact surface 218 for contact, such as longitudinal sliding contact, with respect to the first contact surface 210. A gear train 220 is operatively connected to the media handling tray 104 and to the swing arm 212. The gear train 220 may selectively (i.e., as desired for particular ADF operation) impart rotational motion to the swing arm 212 to cause contact, such as longitudinal sliding contact, between the first and second contact surfaces 210 and 218. A biasing spring 222 urges the media handling tray 104 toward the lifted feeding position. The swing arm 212 counteracts the load from the biasing spring 222 to press the media handling tray 104 toward the lowered ready position, during use of the ADF. As shown in FIG. 2A, the first and second contact surfaces 210 and 218 may be spaced transversely apart when the media handling tray 104 is in the lifted feeding position.

Considered more abstractly, the base arm 206 and swing arm 212 can together comprise a contact interface, serving as first and second contact members of that contact interface, respectively. However, a lifting mechanism 102 of an ADF 100 is referenced herein as an example use environment for a contact interface according to an aspect of the present disclosure. Transversely oriented forces developed between the swing arm 212 and the base arm 206 during contact, such as longitudinal sliding contact, between the first and second contact surfaces 210 and 218 cause selective motion of the media handling tray 104 as desired between the lowered ready and lifted feeding positions.

The second contact surface 218 can be in line contact with the first contact surface 210 while sliding along the first contact surface 210. That is, due to the curvature of the second contact surface 218, only a linear, which may be laterally oriented, portion of the second contact surface 218 may be contacting the first contact surface 210 during a particular instant of the sliding travel of the second contact surface 218 along the first contact surface 210. However, because of the pivotal nature of the swing arm 212 movement, the portion of the second contact surface 218 which is in such line contact with the first contact surface 210 will differ, depending upon when in the relative sliding contact the line contact is observed.

Turning to FIGS. 3-6, the base arm 206 is shown in detail. The first surface 208 includes longitudinally spaced proximal and distal first surface ends 324 and 326, respectively. The first surface 208 also includes laterally spaced left and right first surface edges 328 and 330, respectively. The proximal and distal first surface ends 324 and 326, and the left and right first surface edges 328 and 330 collectively border the first contact surface 210. The first contact surface 210 includes a first material subsurface 332 laterally adjacent a second material subsurface 334.

Figure 3:
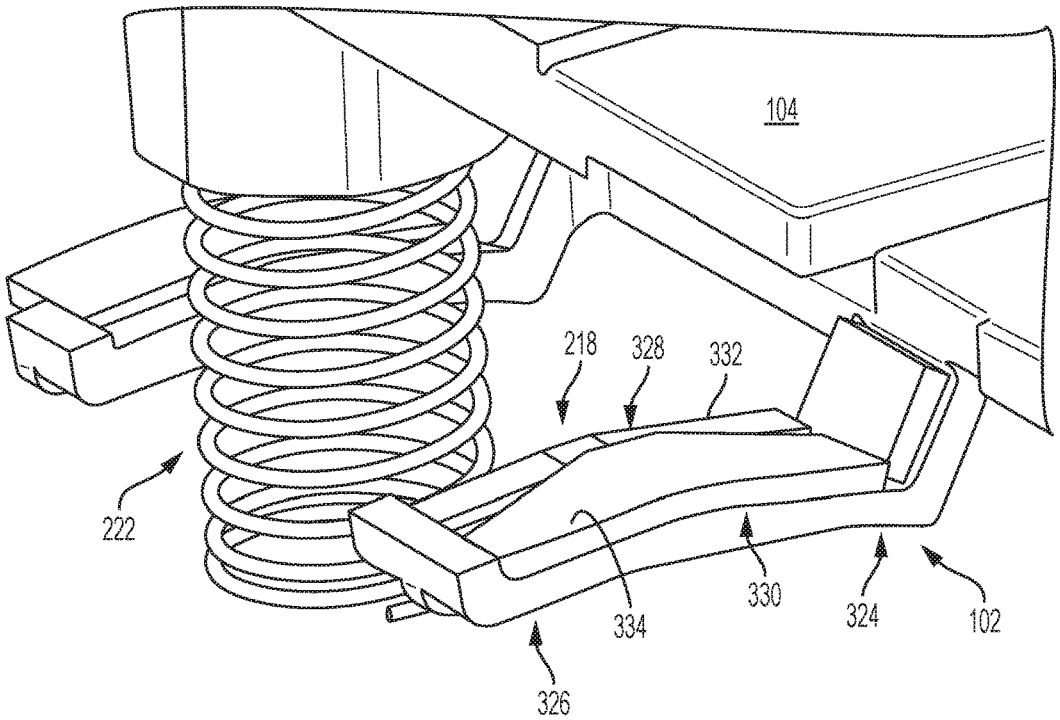
FIG. 3 schematically illustrates a perspective side view of the example ADF of FIG. 1A.

As shown in FIG. 3, the first material subsurface 332 protrudes transversely above the second material subsurface 334 at the proximal and distal first surface ends 324 and 326. The second material subsurface 334 protrudes transversely above the first material subsurface 332 at a portion of the first contact surface 210 which is spaced longitudinally apart from the proximal and distal first surface ends 324 and 326. The first material subsurface 332 comprises a first material. The second material subsurface 334 comprises a second material.

The second material has a lower hardness than the first material. For example, the first material can have a Shore durometer hardness of 70-80 on the "D" scale, and the second material can have a Shore durometer hardness of 40-50 on the "A" scale. Stated differently, the first material is harder than the second material. The second material may have a higher coefficient than the first material. Some examples of suitable first materials are ABS plastic, polycarbonate, polyoxymethylene, other polymers, or any other desired rigid material. Some examples of suitable second materials are foam, silicone, cork, ethylene propylene diene monomer (M-class) rubber, other natural or synthetic rubbers, or any other desired compliant material.

The various materials of the first contact surface 210 can be operative to help provide a desired combination of cushioning, acoustic damping, and wear resistance for the contact interface of the first contact surface 210 and the second contact surface 218. To that end, the second material can cushion contact between the first and second contact surfaces 210 and 218 during longitudinal travel of the second contact surface 218 through a travel region where the geometry of the gear train 220 causes a sudden impact between the first and second contact surfaces 210 and 218. In this arrangement, the second material is operative to mitigate acoustic noise caused by the sudden impact.

Figure 5:
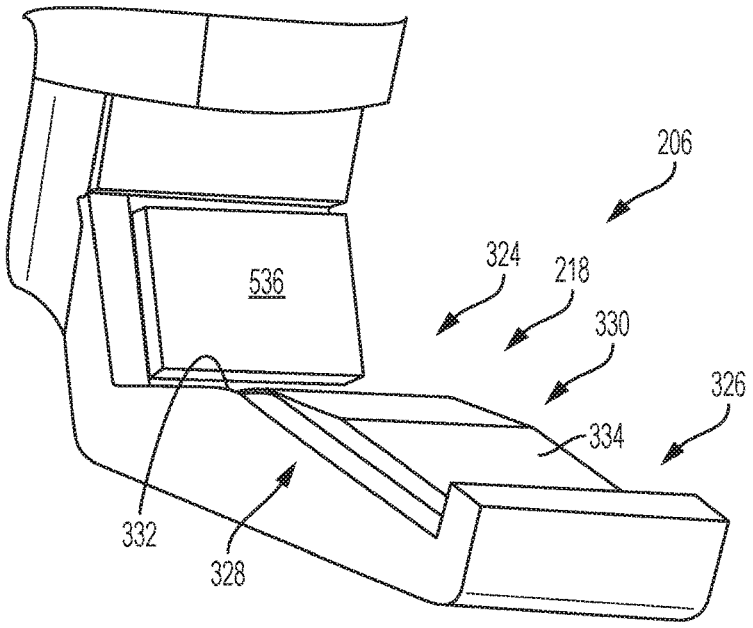
FIG. 5 schematically illustrates a perspective side view similar to FIG. 3.
Figure 6:
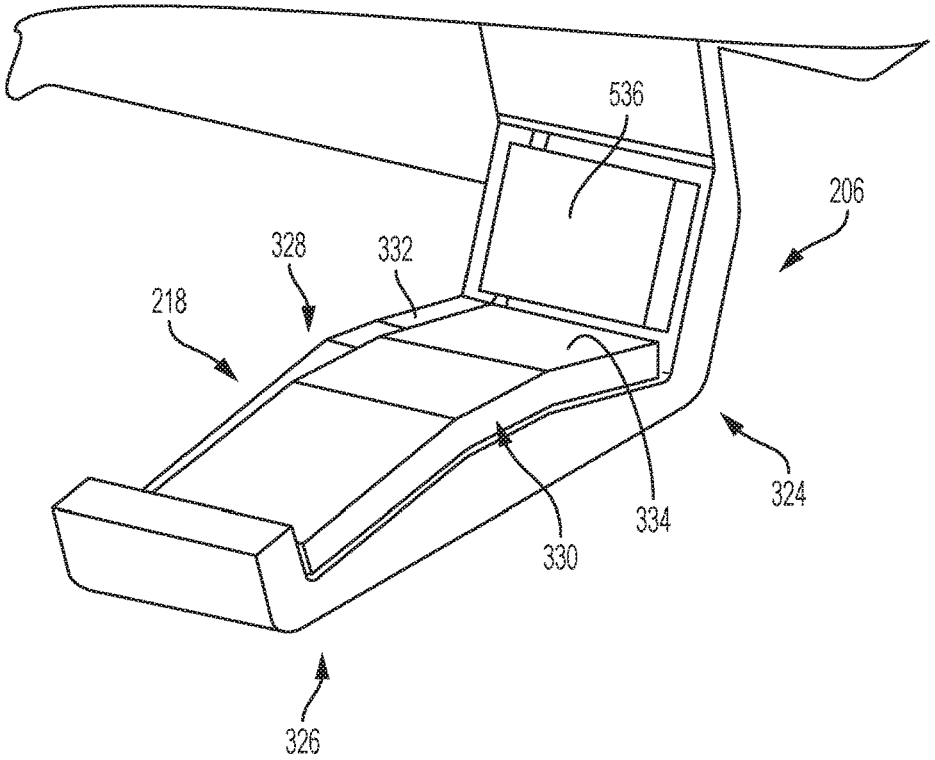
FIG. 6 schematically illustrates a perspective side view similar to FIG. 3.

As shown in FIGS. 5-6, the first and second material subsurfaces 332 and 334 can both be contoured convexly transversely upward (i.e., in a "rainbow" shape, in the orientation of FIGS. 5-6). In the depicted example arrangement, the second material subsurface 334 is contoured at a steeper angle than the contour angle of the first material subsurface 332. As an artifact of these different contour angles, the proximal and distal ends of the first material subsurface 332 are transversely higher than the proximal and distal ends of the second material subsurface 334, and a "central" portion of the first material subsurface 332 is transversely lower than a corresponding "central" portion of the second material subsurface 334, as shown in the Figures. Therefore, as the second contact surface 218 travels longitudinally along the first contact surface 210, the second contact surface 218 is in contact with only a chosen one of the first and second material subsurfaces 332 and 334 of the first contact surface 210 at any selected time during travel (e.g., sliding) of the second contact surface 218 along the first contact surface 210.

In other words, the varying heights of the first and second material subsurfaces 332 and 334 cause the second contact surface 218 to be in direct operative contact with only one of the first and second materials as the second contact surface 218 slides longitudinally along the first contact surface 210. It is contemplated, for example, that the first material subsurface 332 can be 0.5-1.0 millimeters transversely "above" the second material subsurface 334 at the proximal and distal first surface ends 324 and 326, and the second material subsurface 334 can be 0.5-1.0 millimeters transversely "above" the first material subsurface 332 at a portion of the first contact surface 210 that is longitudinally spaced from both the proximal and distal first surface ends 324 and 326, for certain implementations of the described technology. Accordingly, even though the first and second material subsurfaces 332 and 334 are transversely beside each other, they can collectively form a first contact surface 210 which presents varying materials to the second contact surface 218, as the second contact surface 218 slides longitudinally along the first contact surface 210.

Figure 4:
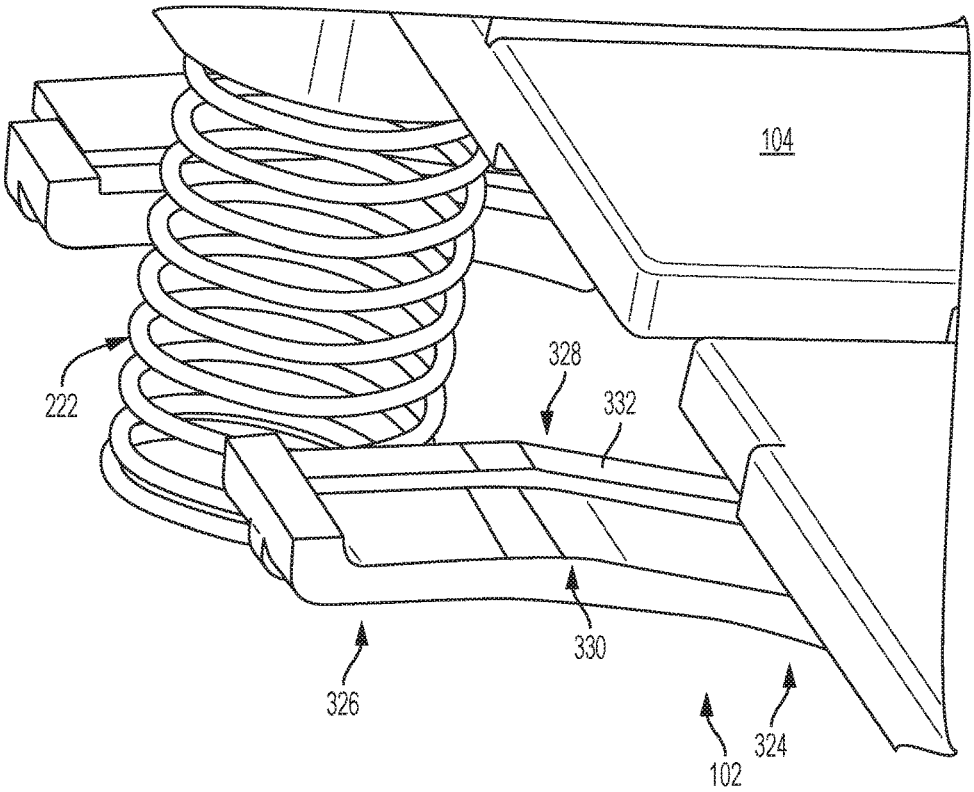
FIG. 4 schematically illustrates a perspective side view of a component of FIG. 3.

As an aside concerning FIG. 4, the second material subsurface 334 has been removed to show the manner in which the first material subsurface 332 can be formed collectively with the majority of the base arm 206. Also, with reference to FIGS. 5-6, a transversely extending pad 536, which can be made, for example, from the second material, may be provided on a portion of the base arm 206 which is spaced from the first contact surface 210 for any reason, such as to provide additional cushioning for the interaction of the swing arm 212 with the base arm 206 while the swing arm 212 is working to lift and lower the media handling tray 104.

Figure 7A:
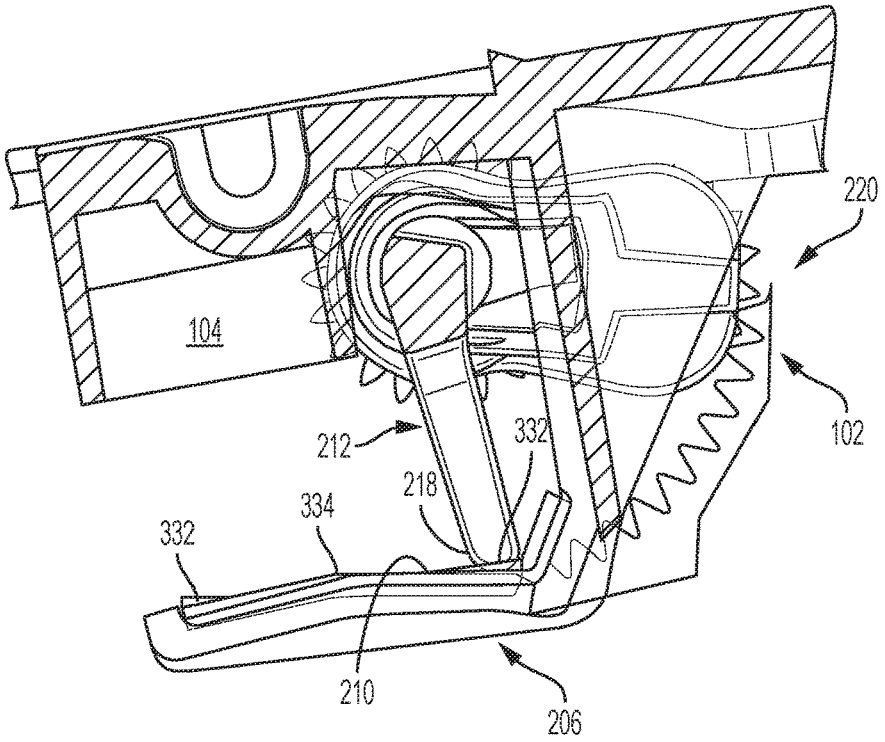
FIGS. 7A-7C schematically illustrate a side view of a sequence of operation of the example ADF of FIG. 1A.
Figure 7B:
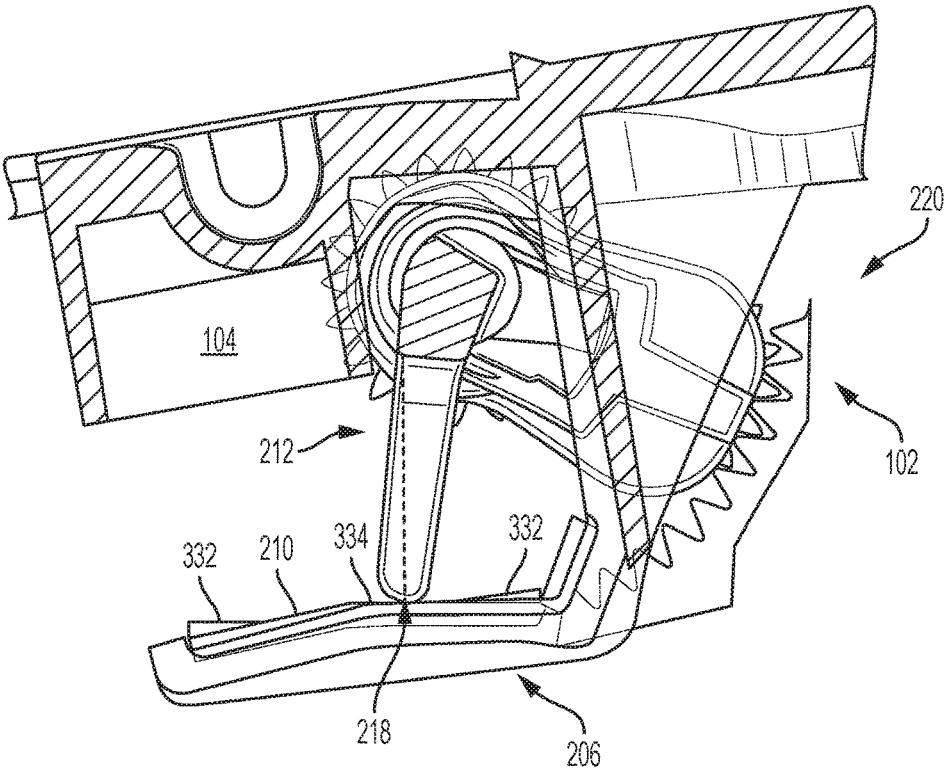
Figure 7C:
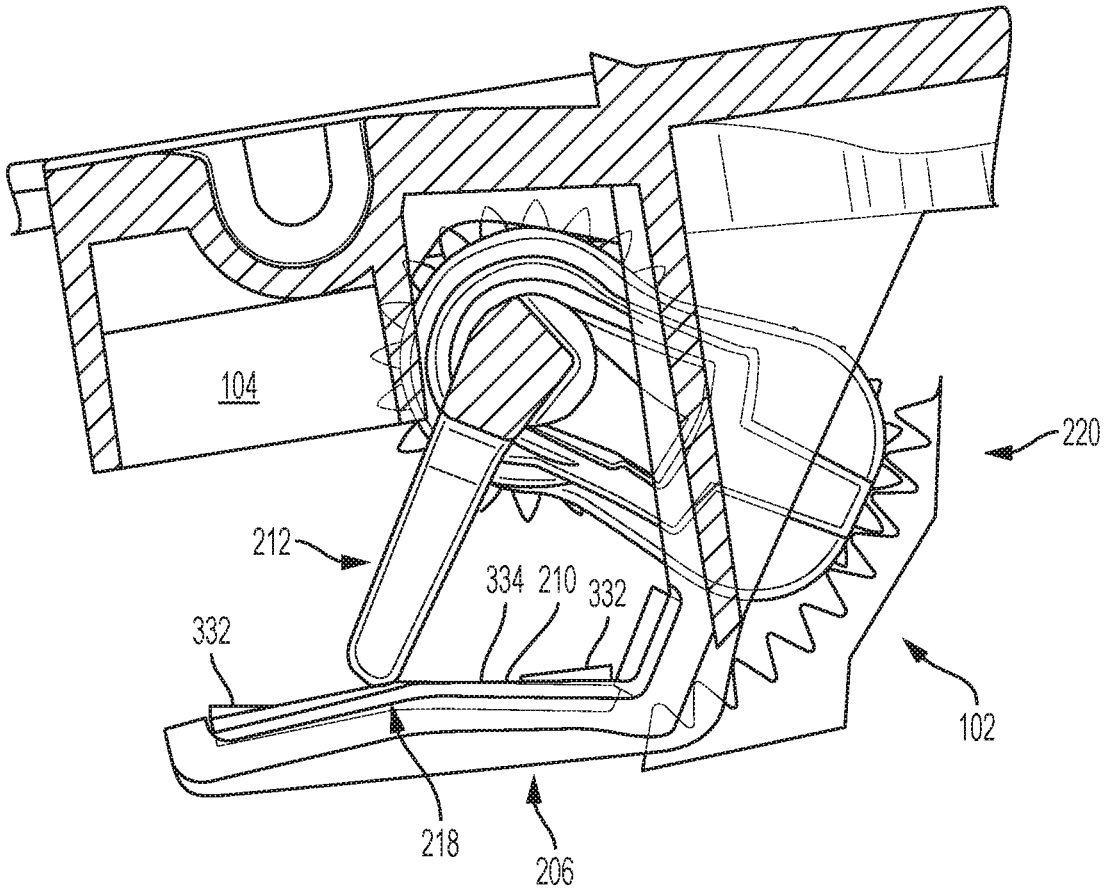
Figure 8:
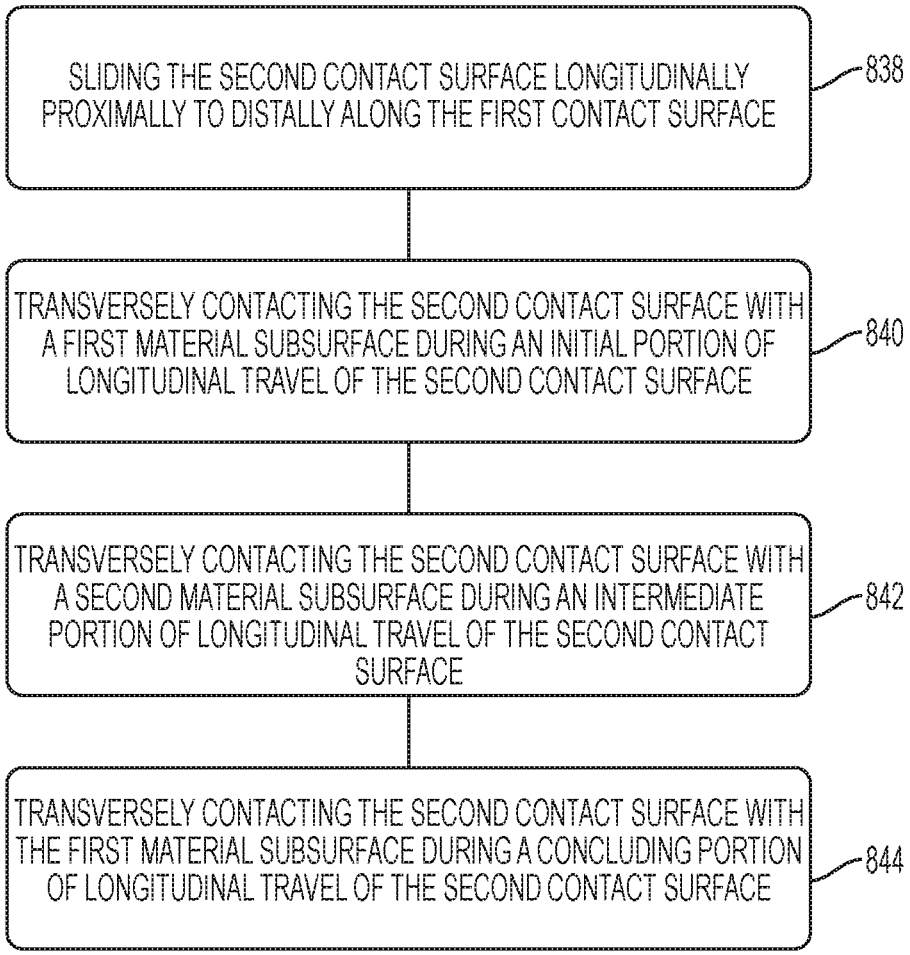
FIG. 8 is a flowchart depicting an example sequence of use of the example ADF of FIG. 1A.

FIGS. 7A-7C, and the flow chart of FIG. 8, depict a method of affecting contact between first and second surfaces. As shown in first action block 838 of FIG. 8, the second contact surface 218 is slid longitudinally proximally to distally along the first contact surface 210. (It is contemplated that a similar method can be used for distal-to-proximal travel, with the "initial" and "concluding" references reversed, such as, for example, when the media handling tray 104 is transitioning between lowered ready and lifted feeding positions, rather than the description in these Figures of a transition between lifted feeding and lowered ready positions.) As shown in FIGS. 7A-7C, this process of moving the second contact surface 218 longitudinally includes rotating a swing arm 212, including the second contact surface 218, with respect to the first contact surface 210. During the sliding motion of the second contact surface 218 along the first contact surface 210, contact between the second contact surface 218 and the first material subsurface 332 can be temporally separated (i.e., separated in time) from contact between the second contact surface 218 and the second material subsurface 334 during travel of the second contact surface 218 across the first contact surface 210.

Proceeding to second action block 840 of FIG. 8, this temporal separation begins to be described. The second contact surface 218 is transversely contacted with the first material subsurface 332 during an initial portion of longitudinal travel of the second contact surface 218, as shown in the transition from FIG. 7A to FIG. 7B. In third action block 842 of FIG. 8, then, the second contact surface 218 is transversely contacted with the second material subsurface 334 during an intermediate portion of longitudinal travel of the second contact surface 218, as shown in FIG. 7B.

FIG. 7C depicts a situation which can occur during longitudinal sliding motion of the second contact surface 218 along the first contact surface 210. In this situation, forces developed within the gear train 220 and between the gear train 220 and the swing arm 212 can cause the swing arm 212 to "snap" or "hitch", causing a discontinuity in an otherwise relatively smooth longitudinal sliding motion along the first contact surface 210. For certain geometries of the lifting mechanism 102, this "snapping" of the swing arm 212 can even cause the second contact surface 218 to lift slightly off from the first contact surface 210 and then slam, potentially noisily, back down onto the first contact surface 210. When this "snapping" situation occurs, the second material subsurface 334 may be placed to "catch" the tip 214 of the swing arm 212, and thus mitigate the noise caused by this "snapping" behavior. This is an example of a travel region where the geometry of the gear train 220 causes a sudden impact between the first and second contact surfaces 210 and 218.

Regardless of whether there is a "snapping" situation, though, the second contact surface 218 can continue to travel longitudinally along an intermediate portion of the first contact surface 210. Then, as described in fourth action block 844 of FIG. 8, though not depicted pictorially in the Figures, the second contact surface 218 may be transversely contacted with the first material subsurface 332 during a concluding portion of longitudinal travel of the second contact surface 218, as the swing arm 212 continues to turn.

Eventually, the swing arm 212 achieves the position shown in FIG. 2A, coming parallel to at least a portion of the first contact surface 210.

Accordingly, a lifting mechanism 102 including the described structures can provide cushioning contact between the first and second contact surfaces 210 and 218 by selection of the first and second material subsurfaces 332 and 334. The first and second material subsurfaces 332 and 334 can be designed, for example, such that the first material subsurface 332 comprises a first material, the second material subsurface 334 comprises a second material, and the second material has a lower hardness than the first material.

Relative terms used to describe the structural features of the figures illustrated herein, such as above and below, up and down, first and second, near and far, left and right, etc., are in no way limiting to conceivable implementations. For instance, where examples of the structure described herein are described in terms consistent with the figures being described, and actual structures can be viewed from a different perspective, such that above and below may be inverted, e.g., below and above, or placed on a side, e.g., left and right, etc. Such other interpretations are fully embraced and explained by the figures and description provided herein. When a plurality of elements pictured in a Figure are similar, only a subset of them may be labeled with element numbers for clarity, but no significance should be attached to the presence or absence of an element number on specific ones of that plurality of elements.

What have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims. Additionally, where the disclosure or claims recite "a," "an," "a first," or "another" element, or the equivalent thereof, it should be interpreted to include at least one such element, neither requiring nor excluding two or more such elements. As used herein, the term "includes" means includes but not limited to, and the term "including" means including but not limited to. The term "based on" means based at least in part on.

What is claimed is:

1. A contact interface, comprising:

a first contact member including a first contact surface with a first material subsurface and a second material subsurface, the first contact member including longitudinally spaced proximal and distal first surface ends, the second material subsurface protruding transversely above the first material subsurface at a portion of the first contact surface spaced longitudinally apart from the proximal and distal first surface ends; and a second contact member including a second contact surface to slide in contact with the first contact surface;

wherein the first material subsurface comprises a first material, the second material subsurface comprises a second material, and the second material has a lower hardness than the first material, and further wherein the second contact member comprises a tip of a pivotally mounted swing arm, the swing arm rotating to slide the second contact surface along the first contact surface.

2. The contact interface of claim 1, wherein the second contact surface is in contact with only a chosen one of the first and second material subsurfaces of the first contact surface at any selected time during sliding of the second contact surface along the first contact surface.

3. The contact interface of claim 1, wherein the first and second material subsurfaces are both contoured convexly transversely upward, and the second material subsurface is contoured at a steeper angle than the contour angle of the first material subsurface.

4. A device, comprising:

a first contact member, including longitudinally spaced proximal and distal first surface ends bordering a first contact surface, the first contact surface including a first material subsurface laterally adjacent a second material subsurface, the first material subsurface protruding transversely above the second material subsurface at the proximal and distal first surface ends, and the second material subsurface protruding transversely above the first material subsurface at a portion of the first contact surface spaced longitudinally apart from the proximal and distal first surface ends; and a second contact member, including a second contact surface for longitudinal sliding contact with respect to the first contact surface;

wherein the first material subsurface comprises a first material, the second material subsurface comprises a second material, and the second material has a lower hardness than the first material.

5. The device of claim 4, wherein the second contact member comprises a tip of a pivotally mounted swing arm, the swing arm rotating to slide the second contact surface along the first contact surface.

6. The device of claim 4, wherein the second contact surface is in line contact with the first contact surface while sliding along the first contact surface.

7. The device of claim 4, wherein the second contact surface is in contact with only a chosen one of the first and second material subsurfaces of the first contact surface at any selected time during travel of the second contact surface along the first contact surface.

8. The device of claim 4, wherein the first and second material subsurfaces are both contoured convexly transversely upward, and the second material subsurface is contoured at a steeper angle than the contour angle of the first material subsurface.

9. A device comprising:

a base arm to support a first surface, the first surface including longitudinally spaced proximal and distal first surface ends and laterally spaced left and right first surface edges to border a first contact surface, a first contact member including a first contact surface with a first material subsurface and a second material subsurface, the second material subsurface to protrude transversely above the first material subsurface, and wherein the first material subsurface comprises a first material, the second material subsurface comprises a second material, and the second material has a lower hardness than the first material;

a pivotally mounted swing arm having a tip comprising a second contact member, a second contact surface of the second contact member to slide in contact with the first contact surface; and a gear train operatively connected to a media handling tray and to the swing arm to cause the contact between the first and second contact surfaces;

wherein transversely oriented forces developed between the swing arm and the base arm during contact between the first and second contact surfaces cause selective motion of the media handling tray between lowered ready and lifted feeding positions.

10. The device of claim 9, wherein the second contact surface is in contact with only a chosen one of the first and second material subsurfaces of the first contact surface at any selected time during travel of the second contact surface along the first contact surface.

11. The device of claim 9, wherein the first and second material subsurfaces are both contoured convexly transversely upward, and the second material subsurface is contoured at a steeper angle than the contour angle of the first material subsurface.

12. The device of claim 9, including a biasing spring to urge the media handling tray toward the lifted feeding position.

13. The device of claim 9, wherein the second material cushions contact between the first and second contact surfaces during longitudinal travel of the second contact surface through a travel region where the geometry of the gear train causes a sudden impact between the first and second contact surfaces, the second material to mitigate acoustic noise caused by the sudden impact.

14. The device of claim 9, wherein the first and second contact surfaces are spaced transversely apart when the media handling tray is in the lifted feeding position.

* * * * *